US005634367A

United States Patent [19]

Yamada et al.

[11] Patent Number: 5,634,367

[45] Date of Patent: Jun. 3, 1997

[54] PRESS FORMING DEVICE

[75] Inventors: Toyonobu Yamada, Mie-ken; Tadasi Morisima, Aichi-ken; Nobutake Aikura, Mie-ken, all of Japan

[73] Assignee: Kabushiki Kaisha Toshiba, Kawasaki, Japan

[21] Appl. No.: 395,928

[22] Filed: Feb. 28, 1995

[30] Foreign Application Priority Data

Apr. 18, 1994 [JP] Japan ..... 6-078467

[51] Int. Cl.[6] ..... B21D 15/02; B21D 51/16

[52] U.S. Cl. ..... 72/402; 72/370

[58] Field of Search ..... 72/402, 400, 370, 72/312–315

[56] References Cited

U.S. PATENT DOCUMENTS

| | | | |
|---|---|---|---|
| 461,812 | 10/1891 | Burkhardt | 72/402 |
| 2,999,405 | 9/1961 | Ewart | 72/402 |
| 3,370,451 | 2/1968 | Schuetz | 72/402 |
| 4,154,082 | 5/1979 | Beech | 72/402 |
| 4,381,659 | 5/1983 | Welch | 72/370 |
| 4,470,288 | 9/1984 | Takeda | 72/402 |
| 4,470,290 | 9/1984 | Jungesjo | 72/402 |
| 5,447,048 | 9/1995 | Tanaka | 72/402 |

FOREIGN PATENT DOCUMENTS

| | | | |
|---|---|---|---|
| 53-139106 | 12/1978 | Japan . | |
| 56-150952 | 11/1981 | Japan . | |
| 1323175 | 7/1987 | U.S.S.R. | 72/402 |

*Primary Examiner*—Daniel C. Crane

*Attorney, Agent, or Firm*—Oblon, Spivak, McClelland, Maier & Neustadt, P.C.

[57] ABSTRACT

A press forming device for forming a plurality of inwardly directed projections on a circumferential wall of a tubular article to be formed. The press forming device includes a lower die holder adapted to be mounted on a lower base of a press machine, and a die fixed on the lower die holder. The die has a plurality of inside forming parts on a circumferential surface of the die, each for forming one of the projections, respectively. The press forming device further includes a plurality of punches mounted on the lower die holder around an outer circumference of the die, each being arranged to be capable of being moved towards or away from the die, and each having an outside forming part in a position facing one of the inside forming parts for forming one of the projections, respectively. The press forming device also includes an upper die holder adapted to be mounted on an upper raising and lowering base of the press machine and a plurality of pressing members of wedge shape mounted on the upper die holder. Each of the pressing members is mounted at a position above one of the punches for moving one of the punches in a direction towards the die with lowering the raising and lowering base, to thereby press the tubular article between one of the inside forming parts of the die and one of the outside forming parts of the punches, respectively.

8 Claims, 9 Drawing Sheets

PRESS FORMING DEVICE

BACKGROUND OF THE INVENTION

Field of the Invention

This invention relates to a press forming device, and more particularly to a press forming device that forms a plurality of inwardly directed projections on the circumferential wall of a tubular article to be formed.

Description of the Related Art

An electric motor frame 1 is shown in FIG. 4. This motor frame I is cylindrical in shape and is provided with inwardly directed projections 2 in its circumferential wall. When forming motor frame 1 of such a shape, previously a cylindrical article 3 to be formed shown in FIG. 5 could be formed into motor frame I by the following two methods:

The first of these methods is a method as disclosed for example in Japanese Patent Disclosure (Kokai) Sho. 56-150952. As shown in FIG. 14 to FIG. 16, a die 5 having a plurality of forming parts 4 of concave shape is positioned within a pressure vessel 6 and material 3, that is article 3 to be formed, is arranged at the outer periphery of this die 5. Pressurized oil 7 is then used to fill the space between this material 3 and the inner wall of pressure vessel 6. Material 3 is pressed to die 5 (see FIG. 16) by applying pressure to pressurized oil 7. A motor frame 1 of the shape shown in FIG. 4 is thereby formed.

Alternatively, in another method, as shown in FIG. 17 and FIG. 18, a forming device 11 is provided, in which a number of hydraulic cylinders 8 matching the number of projections 2 of motor frame 1 (six in the case of FIG. 18) are arranged at the outer periphery of a die 9, and punches 10 are attached at the rod tips of respective hydraulic cylinders 8. Material 3 is then arranged at the outer periphery of die 9 and hydraulic cylinders 8 are actuated in the direction of die 9. Motor frame 1 is thereby formed with projections 2 formed on it.

However, large equipment costs result from the fact that, in the former case, a high-precision hermetically sealed vessel is required for pressure vessel 6. Additional problems were the long time required for forming and the low manufacturing precision, due to the use of pressurized oil 7 itself for forming.

Moreover, in the latter case, a number of hydraulic cylinders 8 equal in number to the number of projections 2 are required. This makes the equipment large in size so that it needs a lot of space. Furthermore, if each of the hydraulic cylinders 8 is actuated using the same hydraulic pressure source, owing to imbalance of the forming pressure, projections 2 cannot be formed simultaneously and precision of the shape of projections 2 is also adversely affected. Also, if the sheet thickness of material 3 is large, a large forming force is necessary, so that there were limitations on formation by means of hydraulic cylinders 8.

SUMMARY OF THE INVENTION

Accordingly, one object of this invention, in the forming of a plurality of inwardly directed projections on the circumferential wall of a tubular article to be formed, is to provide a press forming device whereby lower equipment costs can be obtained, the space required can be reduced and manufacturing precision can be raised.

These and other objects of this invention can be achieved by providing a press forming device for forming a plurality of inwardly directed projections on a circumferential wall of a tubular article to be formed. The press forming device includes a lower die holder adapted to be mounted on a lower base of a press machine, and a die fixed on the lower die holder. The die has a plurality of inside forming parts on a circumferential surface of the die, each for forming one of the projections, respectively. The press forming device further includes a plurality of punches mounted on the lower die holder around an outer circumference of the die, each being arranged to be capable of being moved towards or away from the die, and each having an outside forming part in a position facing one of the inside forming parts for forming one of the projections, respectively. The press forming device also includes an upper die holder adapted to be mounted on an upper raising and lowering base of the press machine and a plurality of pressing members of wedge shape mounted on the upper die holder. Each of the pressing members is mounted at a position above one of the punches for moving one of the punches in a direction towards the die with lowering the raising and lowering base, to thereby press the tubular article between one of the inside forming parts of the die and one of the outside forming parts of the punches, respectively. Whereby, the plurality of the projections are formed on the circumferential wall of the tubular article to be formed.

According to another aspect of this invention, there is provided a press forming device for forming a plurality of inwardly directed ribs on a circumferential wall of a tubular article to be formed. The press forming device includes a lower die plate adapted to be mounted on a lower base of a press machine, a lower die fixed on the lower die plate, and a plurality of inserts arranged in a circumference of the lower die, each being movable in a radial direction of the lower die. The press forming device further includes a plurality of punches mounted on the lower die plate around an outer circumference of the lower die, each being arranged to be capable of being moved towards or away from the lower die at an outer position between adjacent two of the inserts, respectively. The press forming device also includes an upper die plate adapted to be mounted on an upper raising and lowering base of the press machine, a plurality of wedges mounted on the upper die plate, each being mounted at a position above one of the inserts, respectively, and a plurality of cams mounted on the upper die plate, each being mounted at a position above one of the punches, respectively. Each of the wedges moves one of the inserts and each of the cams moves one of the punches in a direction towards the lower die with lowering the raising and lowering base, to thereby press the tubular article between the lower die and one of the punches, respectively. Whereby, the plurality of the ribs are formed on the circumferential wall of the tubular article to be formed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
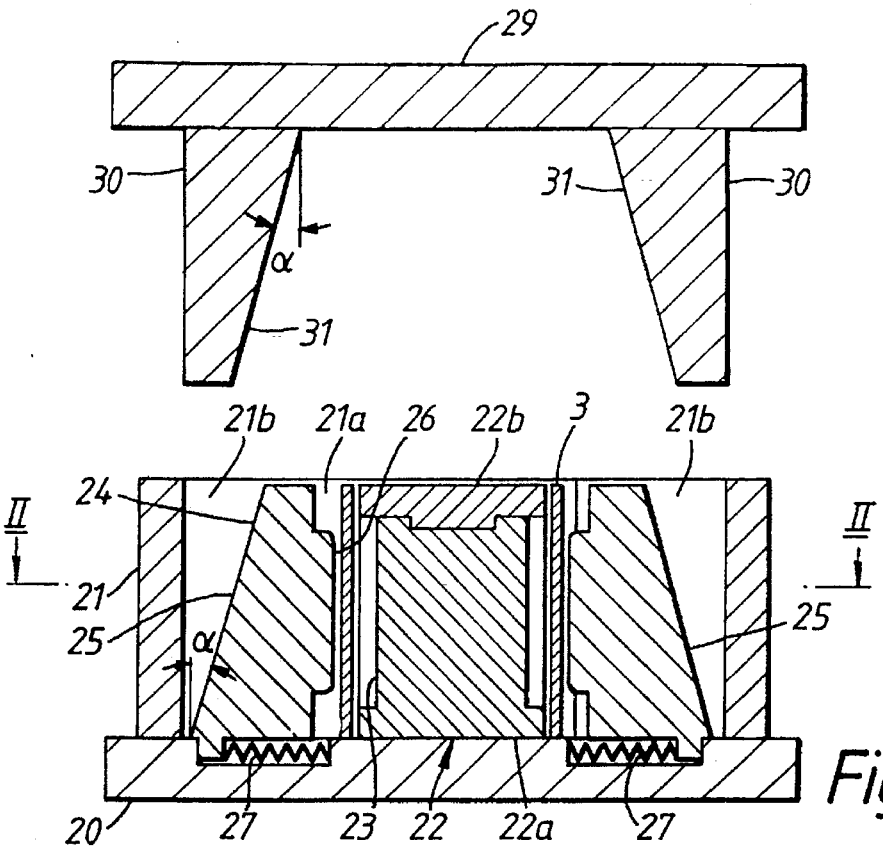
FIG. 1 is an axially sectioned front view illustrating a press forming device according to an embodiment of this invention.

Referring now to the drawings, wherein like reference numerals designate identical or corresponding parts throughout the several views, the embodiments of this invention will be described below.

Figure 2:
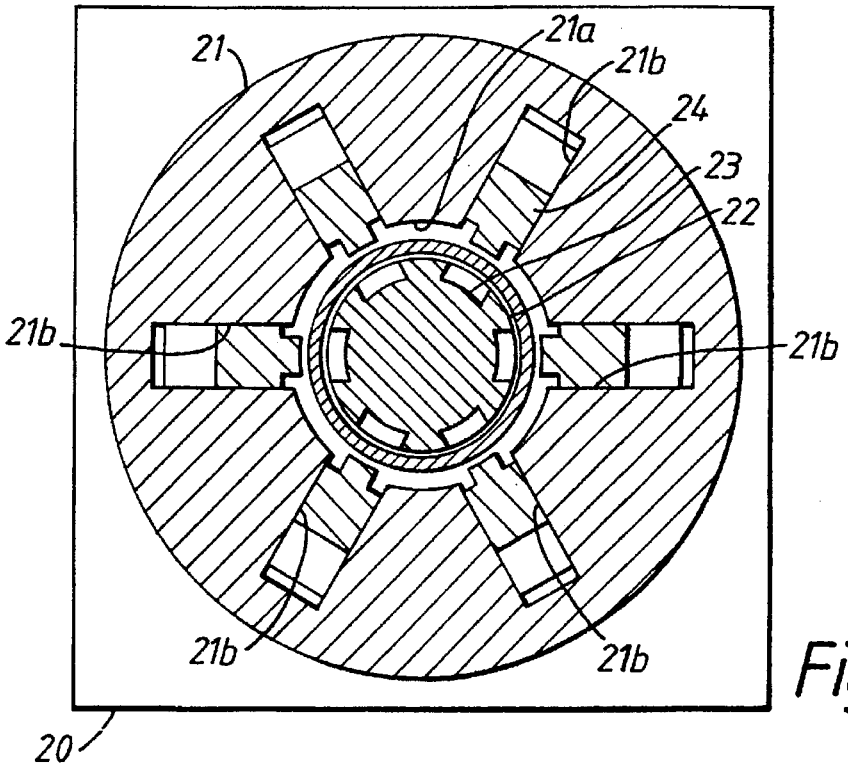
FIG. 2 is a transversely sectioned plan view of the lower die holder along the line II—II in FIG. 1.
Figure 3:
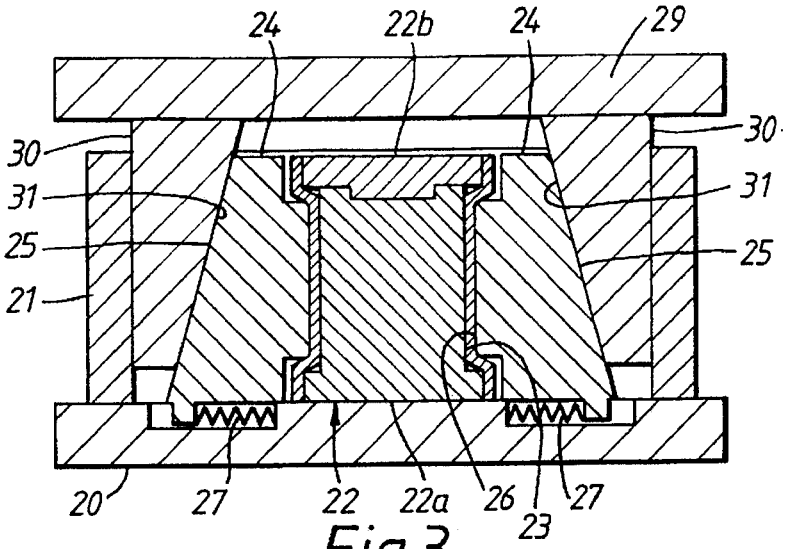
FIG. 3 is an axially sectioned front view given in explanation of the operation of a press forming device shown in FIG. 1.

An embodiment of this invention is described below with reference to FIG. 1 to FIG. 5. A punch holder 21 is arranged in a lower die holder 20. A recess 21*a* of circular cross-section is formed as shown in FIG. 2 at the center of this punch holder 21. Six guide grooves 21*b* are formed in the radial direction from the inside face of this recess 21*a*. A die 22 shaped as a cylindrical pillar practically is mounted on a lower die holder 20 concentrically with recess 21*a* which is the central part of punch holder 21. Six inside forming parts 23 are formed facing respective guide grooves 21*b* at six locations on the circumferential surface of this die 22. In this case, die 22 is composed of a die body 22*a* and a disc-shaped upper plate 22*b* that is releasably mounted on top of die body 22*a*. Inside forming part 23 has a base part formed of a convex arcuate cross-section and is formed so as to be vertically elongate except for its upper and lower ends.

Also, in each guide groove 21*b* at the circumference of die 22 in lower die holder 20 there is provided a punch 24 that is movable towards or away from this die 22. An inclined face 25 is formed at an angle G on the outside face of each of these punches 24 and an outside forming part 26 whose leading end is formed in concave arcuate cross section is formed on the inside face of each of punches 24. These outside forming parts 26 face the inside forming parts 23 of die 22, respectively. Each punch 24 is biassed by means of a tension spring 27 for movement in the direction away from die 22. Lower die holder 20 equipped with these punch holders 21, die 22 and punches 24 etc., is arranged to be mounted on a lower base of a pressing machine, not shown.

Furthermore, six pressing members 30 are mounted in a circular position, and in equally spaced configuration on an upper die holder 29. Pressing members 30 are positioned above respective punches 24. An inclined face 31 of an angle $\alpha$ is formed on each of inside surfaces of pressing members 30 so as to constitute a wedge shape. Upper die holder 29 is arranged to be mounted on an upper raising and lowering base of the pressing machine, not shown.

Figure 5:
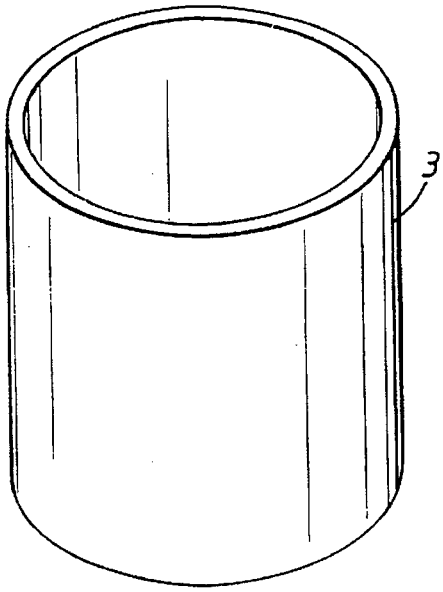
FIG. 5 is a perspective view of an article to be formed.

Next, the operation of the embodiment with the above construction will be described. Now, tubular article 3 to be formed shown in FIG. 5 is arranged between die 22 and punches 24 such that die 22 is located on the inside relative to article 3 to be formed, and punches 24 are located at the circumference of article 3 to be formed. After this, the upper raising and lowering base of the pressing machine (not shown) is lowered, thereby lowering pressing members 30. As a result, inclined faces 31 of pressing members 30 come into contact with inclined faces 25 of punches 24, respectively. With further downward movement of pressing members 30, punches 24 move towards the center of die 22 against the spring forces of springs 27, respectively. As a result, article 3 to be formed is clamped between inner forming parts 23 of dies 22 and outer forming parts 26 of punches 24, thereby forming the projections 2 (see FIG. 3), which have, at the inner diameter of the projections, an arcuate shape similar to the inner diameter of article 3 to be formed.

Figure 4:
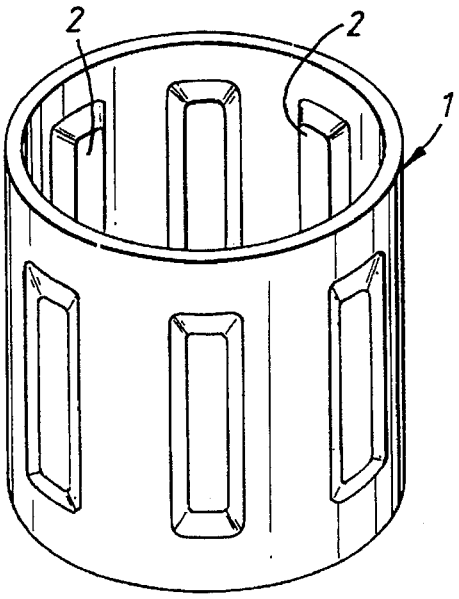
FIG. 4 is a perspective view of a motor frame.

After this, the upper raising and lowering base of the pressing machine is raised, raising pressing members 30, and thus moving punches 24 in the direction away from die 22 by means of the spring force of tension springs 27. That is, punches 24 return to their original position. After this, upper plate 22*b* of die 22 is removed and the article, which has now been formed to be motor frame 1 shown in FIG. 4, is extracted. Motor frame 1 is now formed with projections 2.

Thus in this embodiment the projections 2 are formed on article 3 to be formed by movement of punches 24 in the direction of the center of die 22 by the lowering of wedge-shaped pressing members 30. That is, with this embodiment, pressing members 30 can be lowered from above punches 24, so use of a pressing machine becomes possible for producing motor frame 1. In this case, pressing members 30 can be mounted on the upper raising and lowering base while die 22 and punches 24 can be mounted on the lower base of this pressing machine. As a result, equipment cost can be lowered, and the pressing force of the pressing machine can be amplified by the wedge action, so that this enables the forming with large force yet with a small device and also enables the space requirement to be reduced. Also, in this case, production accuracy can be raised as there is scarcely any effect of imbalance of the projection forming forces, due to the adoption of so-called cam-type forming, in which punches 24 are actuated by wedge-shape pressing members 30. Furthermore, the internal diameters of the projections can be formed with even greater precision by carrying out the formation of a plurality of projections concurrently. Alternatively, it is possible to stagger the timings of formation of the individual projections: this makes it possible to reduce the force used in forming.

Although in this embodiment the base part of inside forming part 23 and the leading end of outside forming part 26 are of arcuate shape cross-section, they could be of special shapes other than arcuate shape.

A further embodiment of this invention will now be described. This embodiment is based on the embodiment described with reference to FIG. 1 to FIG. 5, but it is modified in the following two respects. Firstly, in the construction of this embodiment, upper plate 22*b* of die 22 is moved from lower die holder 20 to upper die holder 29. Secondly, the shape of die 22 is made of a shape corresponding to a motor frame of different shape from that in FIG. 4.

The details of this embodiment will now be described with reference to FIG. 6 and FIG. 7.

Figure 6:
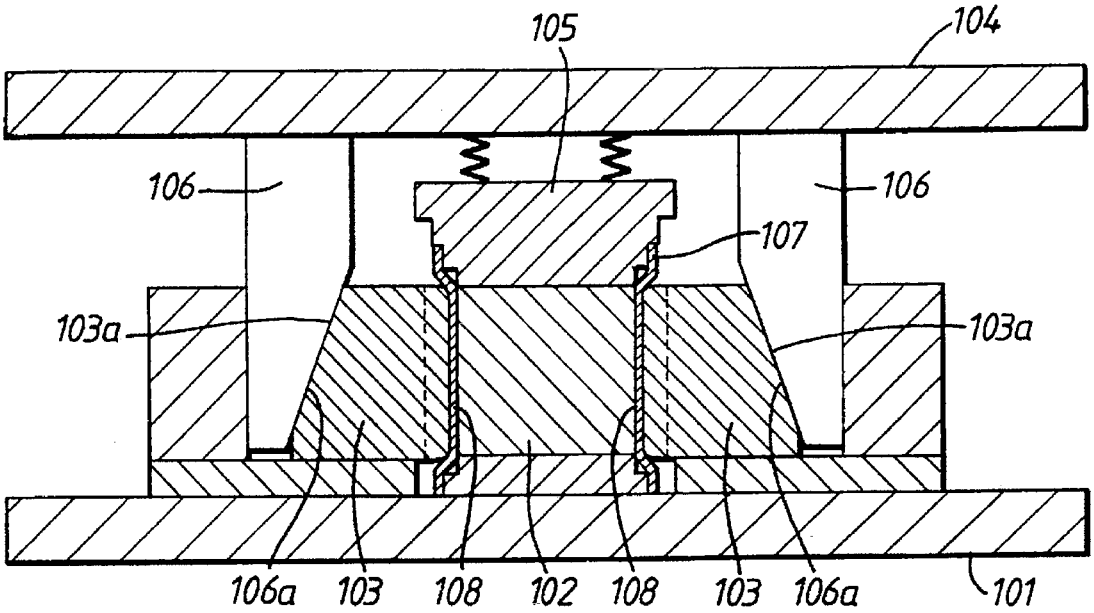
FIG. 6 is an axially sectioned front view illustrating a press forming device according to a further embodiment of the invention.

FIG. 6 shows a press forming device used for press forming of ribs on a tubular workplace such as for example a motor frame made of steel sheet. In FIG. 6, a lower die 102 is arranged on a lower die plate 101 and the required number of punches 103 are arranged on the lower die plate 101 so as to be movable in the direction towards or away from (left or right in FIG. 6) lower die 102 on the outside of this lower die 102. An upper die 105 is arranged facing lower die 102 on upper die plate 104 facing lower die plate 101. Cams 106 whose number is the same as that of punches 103 are provided facing punches 103 on upper die plate 104.

With this construction, a cylindrical workpiece 107 is inserted at the periphery of lower die 102. Next, by lowering upper die plate 104, inclined faces 106*a* of cams 106 are made to slide over the inclined faces 103*a* at the rear of punches 103, causing punches 103 to move in the direction of lower die 102, respectively. Then, when upper die 105 contacts lower die 102, punches 103 abut workpiece 107 and apply pressure to workpiece 107 to effect press forming of ribs 108.

Figure 7:
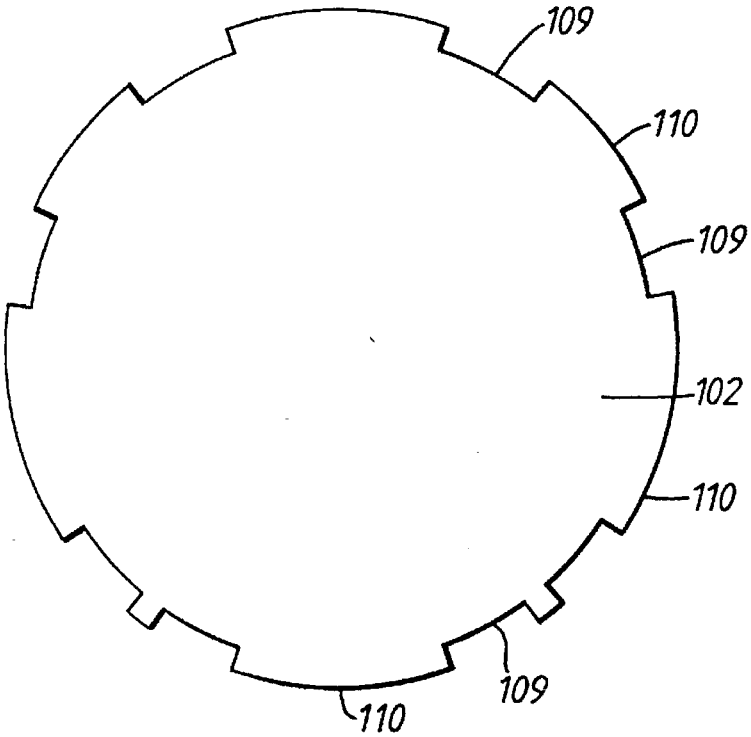
FIG. 7 is a plan view of the lower die in a press forming device shown in FIG. 6.

In the case of a device constructed as above, in general as shown in FIG. 7 lower die 102 is completely integrally constructed and recesses 109 and projections 110 for the formation of ribs 108 are formed alternately at its periphery.

In this embodiment practically equivalent benefits are obtained as in the case of the embodiment illustrated in FIGS. 1–5. Additionally, this embodiment has the merit that the step of removing the upper plate 22*b* after completion of the pressing step can be dispensed with.

Figure 8:
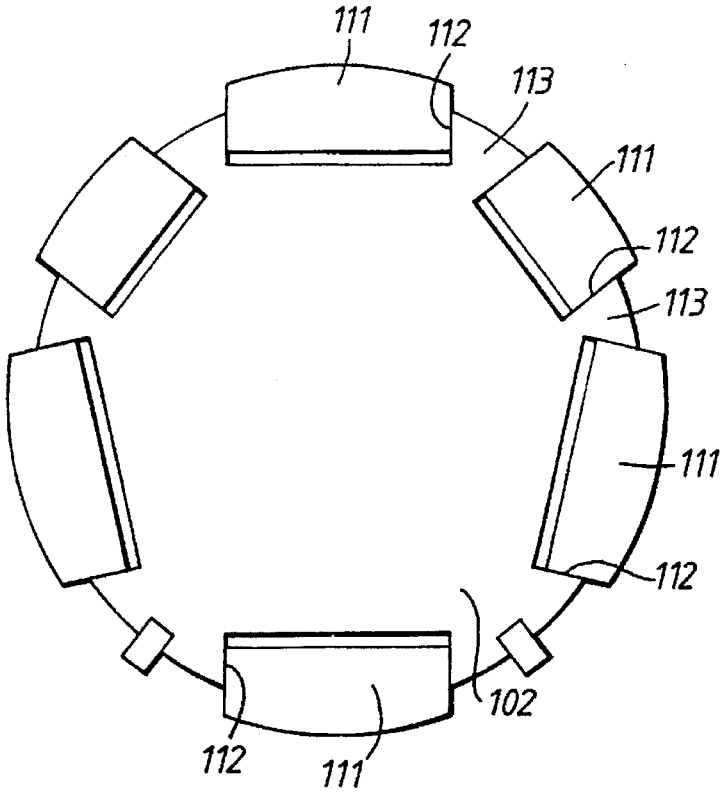
FIG. 8 is a plan view of the lower die in a press forming device according to another embodiment of this invention.

Next, yet a further embodiment of this invention will be described with reference to FIG. 8. In FIG. 8, recesses 112 are provided at locations corresponding to those of projections 110 of lower die 102 of FIG. 7. Also, each of recesses 112 has fitted within it an insert 111 that is movable in the radial direction.

In the case in which a lower die 102 shown in FIG. 7 is employed, there is sometimes difficulty in extracting workpiece 107 after workplace 107 has been press-formed with ribs 108, owing to some degree of meshing between workpiece 107 and the corner parts of recesses 109 or between workpiece 107 and the angular parts of projections 110. However, in the present embodiment, since a construction is adopted in which inserts 111 are provided, workpiece 107 can easily be extracted after press-forming of ribs 108 on workpiece 107.

Another embodiment of this invention will now be described. In FIG. 6, on inclined faces 103*a* of punches 103 and inclined faces 106*a* of cams 106 there are formed for example T-shaped engaging recesses and engaging projections of the same shape. These are brought into engagement by lowering of cam 106. On raising of cam 106, punches 103 are forcibly pulled back, and they are then separated. By this means it is possible to prevent the situation of punches 103 biting into workplace 107 so that they cannot be withdrawn after press-forming of ribs 108 on workpiece 107.

A further embodiment of this invention will now be described with reference to FIG. 9 to FIG. 13.

Figure 10:
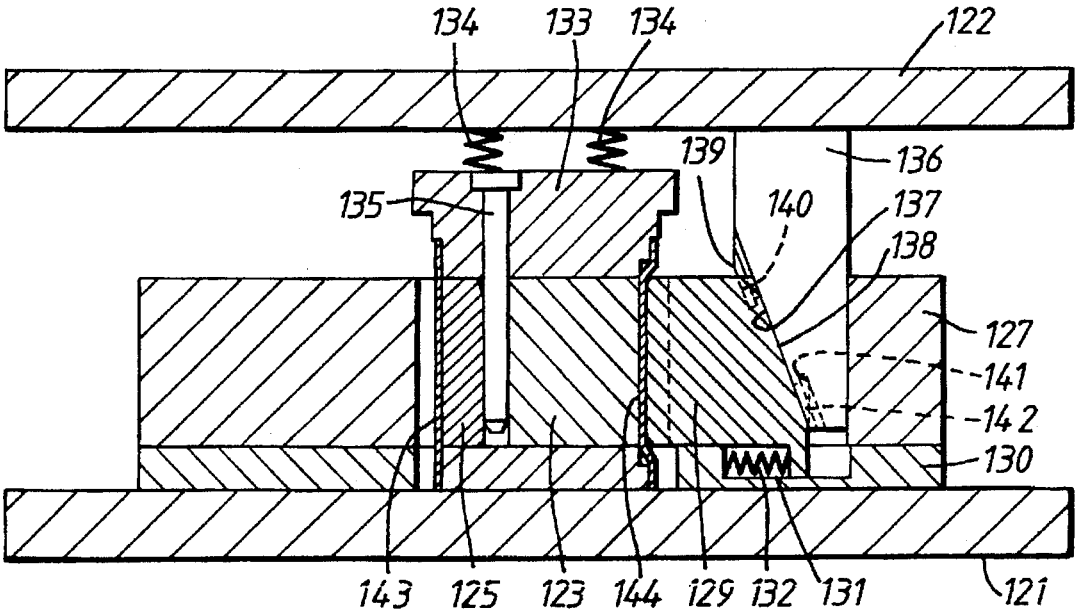
FIG. 10 is an axially sectioned front view of a press forming device shown in FIG. 9.
Figure 9:
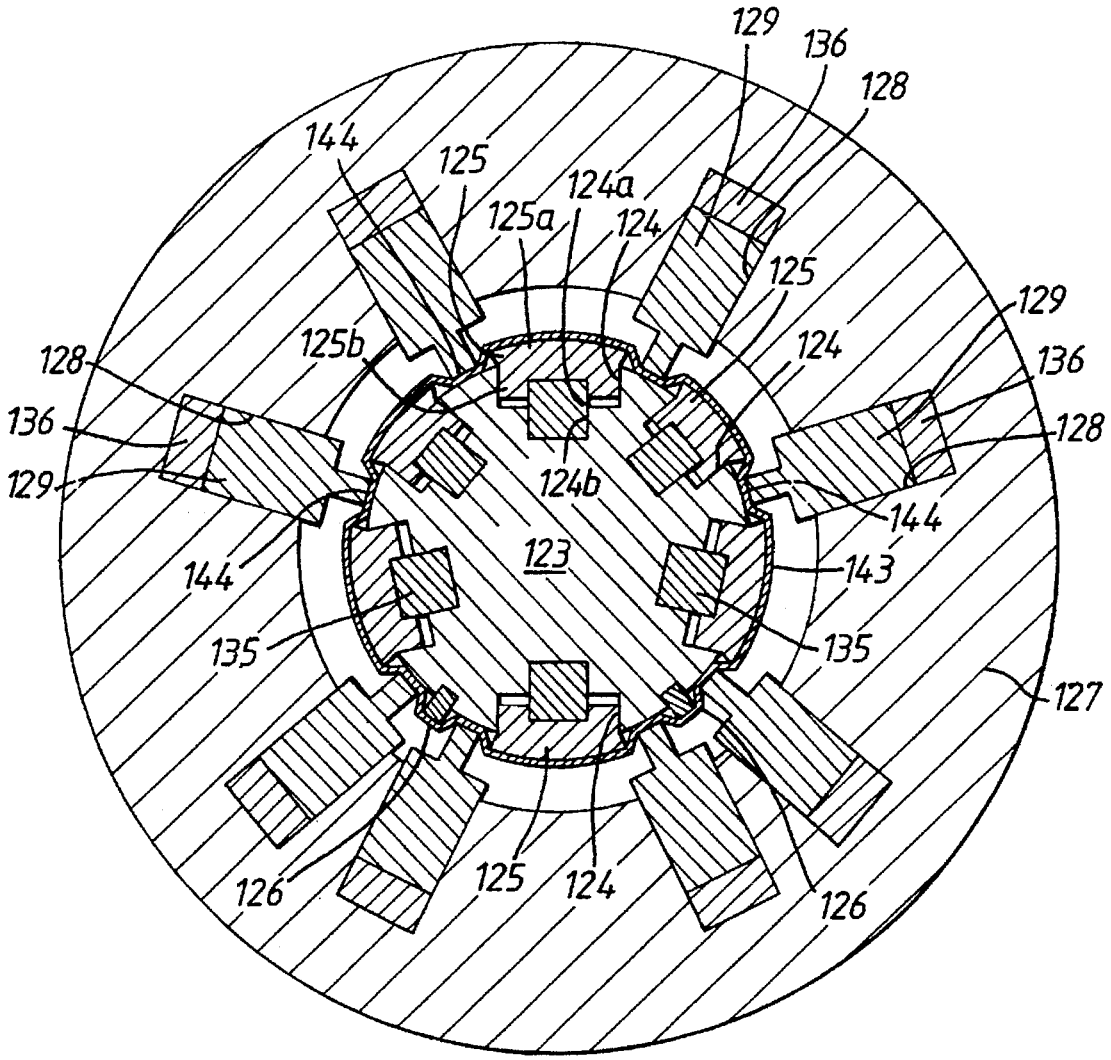
FIG. 9 is a transversely sectioned plan view of a press forming device according to still another embodiment of this invention.

In FIG. 10, a lower die plate 121 faces an upper die plate 122. A lower die 123 is mounted at the middle of lower die plate 121. As shown in FIG. 9, stepped recesses 124 are formed in, for example six locations, at the periphery of this lower die 123. An insert 125 is fitted in each outer part 124*a* of these recesses 124 in such a manner as to be radially movable.

In detail, insert 125 has a tip part 125*a* that is formed with a fan-shaped cross-section, and a base part 125*b* that is formed with a width narrower than that of tip part 125*a* and with rectangular cross-section. Base part 125*b* fits into the outside part 124*a* of recess 124 of lower die 123, while tip part 125*a* projects beyond lower die 123. Aside from this, inserts 126 which are smaller than inserts 125 are fitted in fixed manner at for example two locations in the periphery of lower die 123.

An annular punch plate 127 is arranged outside lower die 123. On the inner circumference of this punch plate 127, there are formed in radial fashion recesses 128 equal in number to inserts 125 and 126. Recesses 128 are in an arrangement alternate to inserts 125 and 126. Respective punches 129 are inserted in these recesses 128, and punches 129 are arranged to be movable in the direction towards or away from lower die 123.

In FIG. 10, there is provided a slide plate 130 whereby punches 129 are made to slide and which is positioned below punch plate 127 and above lower die plate 121. Grooves 131 are formed in this slide plate 130 at locations beneath respective punches 129. Springs 132 are arranged so as to provide restoring force to respective punches 129 accommodated in these grooves 131.

An upper die 133 is arranged, resiliently supported by springs 134, facing lower die 123, in the middle of upper die plate 122. Wedges 135 of the same number as inserts 125 are arranged facing respective inserts 125, in upper die 133, and wedges 135 project below upper die 133. In addition, a number of cams 136 equal in number to that of punches 129 are arranged in projecting manner facing respective punches 129 around upper die 133 of upper die plate 122.

Figure 11:
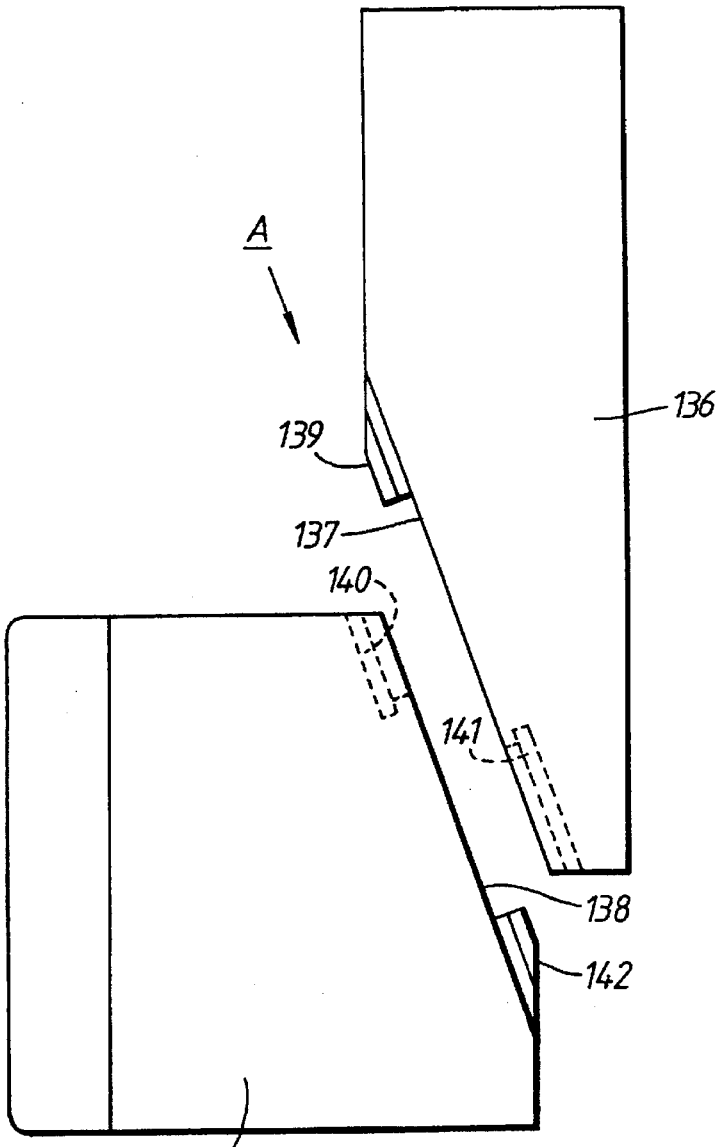
FIG. 11 is a side view of the punch and cam in a press forming device shown in FIG 9.
Figure 12:
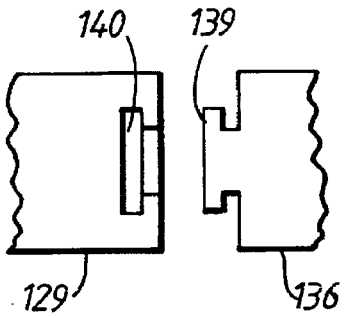
FIG. 12 is a partial view seen from the direction of the arrow A in FIG. 11.

Cams 136 are formed with inclined faces 137, respectively, facing upper die 133. Facing inclined faces 137, punches 129 are formed with inclined faces 138 at their rear parts i.e. on the side away from lower die 123. Engaging projections 139 which are for example T-shaped are formed as shown in FIG. 11 and FIG. 12 at the top of respective inclined faces 137. Engaging recesses 140 of the same shape are formed facing engaging projections 139 at the top of respective inclined faces 138. Also, engaging recesses 141 likewise of T-shape are formed at the bottom of respective inclined faces 137, while engaging projections 142 of the same shape are formed facing engaging recesses 141 at the bottom of respective inclined faces 138.

Figure 13:
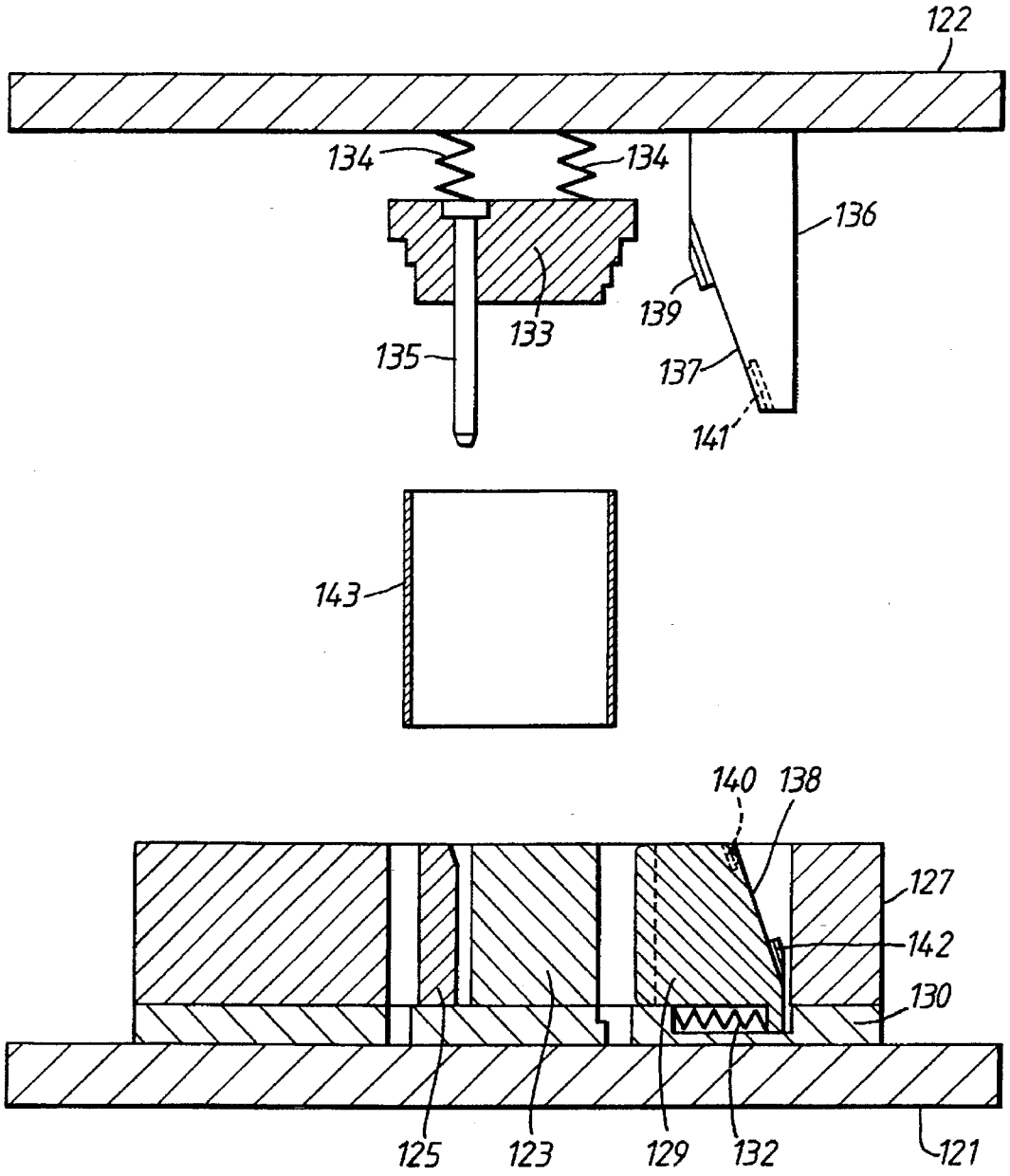
FIG. 13 is an axially sectioned front view showing a press forming device shown in FIG. 9 before forming.
Figure 14:
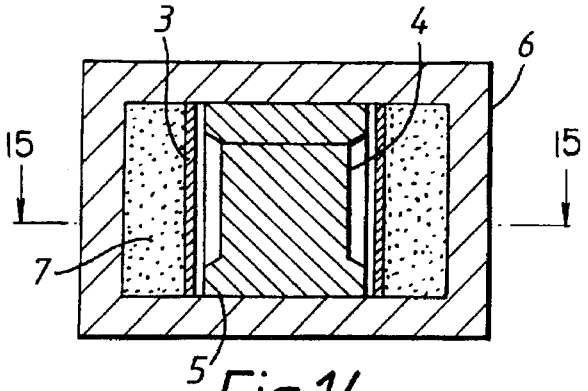
Fig.14 (PRIOR ART)
FIG. 14 is an axially sectioned front view showing a prior art press forming device.
Figure 15:
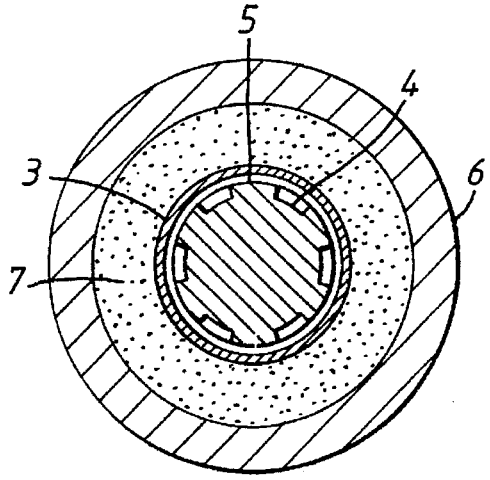
Fig.15 (PRIOR ART)
FIG. 15 is a transversely sectioned plan view along the arrow line 15—15 of FIG. 14.
Figure 16:
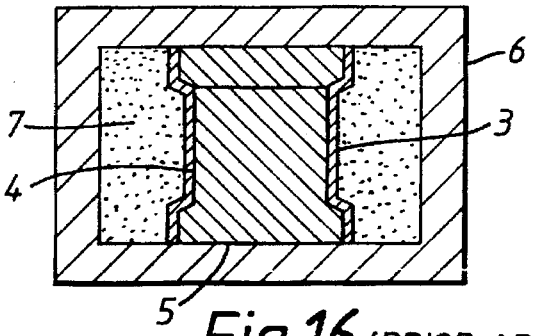
Fig.16 (PRIOR ART)
FIG. 16 is an axially sectioned front view of a press forming device shown in FIG. 14 given in explanation of the operation.
Figure 17:
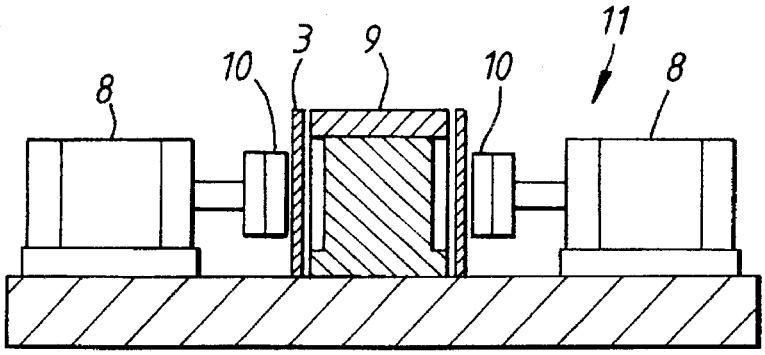
Fig.17 (PRIOR ART)
FIG. 17 is an axially sectioned front view showing a further prior art press forming device.
Figure 18:
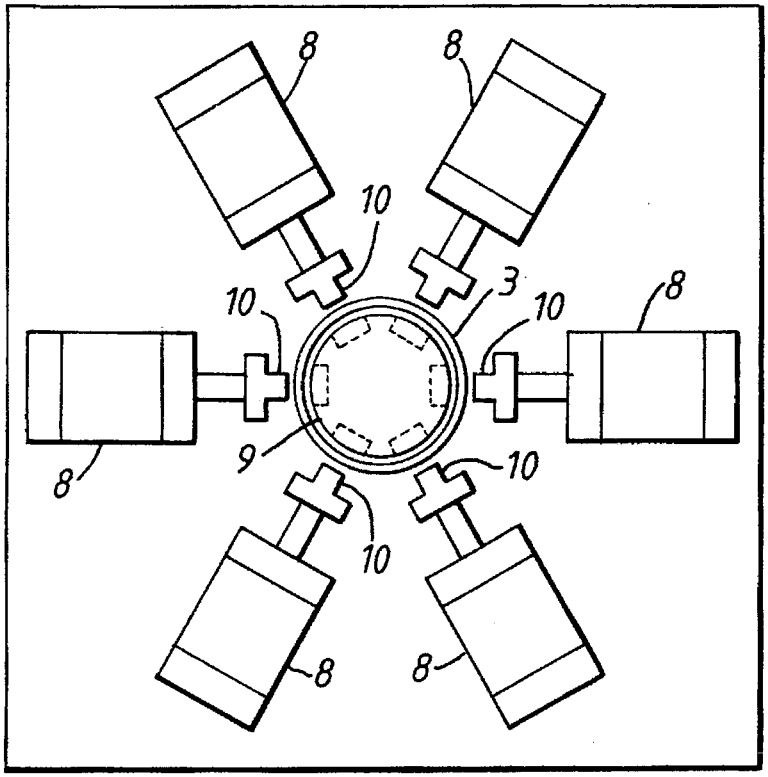
Fig 18 (PRIOR ART)
FIG. 18 is a plan view of a press forming device shown in FIG. 17.

With the above construction, when forming is to be carried out, a cylindrical workpiece 143 as shown in FIG. 13 (e.g. a steel sheet frame for a motor) is fitted over lower die 123. At this time, all inserts 125 are in free condition so that when inserts 125 come into contact with workpiece 143, they retract inwards to allow smooth mounting of workpiece 143.

Next, the forming operation is commenced, causing upper die plate 122 to descend together with upper die 133, wedges 135 and cams 36. When this happens, wedges 135 enter respective interiors 124*b*, between the back part of recess 124 and insert 125 of recesses 24 of lower die 23, causing inserts 125 to be moved outwards until respective inserts 125 abut the inner circumferential surface of workpiece 143. Also, cams 136 cause engaging projections 139 to engage respective engaging recesses 140 and cause engaging recesses 141 to engage respective engaging projections 142, and cause inclined faces 137 to slide on respective inclined faces 138 of punches 129, thereby causing punches 129 to be moved in the direction of lower die 123. Then, when upper die 133 has come into contact with lower die 123 as shown in FIG. 9 and FIG. 10, punches 129 contact workpiece 143, applying pressure between the respective parts of workpiece 143 that are received by inserts 125, causing ribs 144 to be press-formed.

After the forming, upper die plate 122 is returned upwards together with upper die 133, wedges 135, and cams 136. As a result, punches 129 are forcibly retracted since cams 136 pull engaging recesses 140 by means of engaging projections 139 and pull engaging projections 142 by means of engaging recesses 141, respectively. After this, engaging projections 139 are separated from engaging recesses 140 and engaging recesses 141 are separated from engaging projections 142, respectively. Also, et this time, punches 129 are retracted by the restoring forces of respective springs 132.

Also, in this case, wedges 135 are extracted from respective interiors **124*b* of recesses 124 of lower die 123, which causes respective inserts 125 to return to a free condition. As a result, when subsequently workpiece 143 is pushed upwards by an ejector, not shown, if there is any pressure on inserts 125 due to workpiece 143, inserts 125 retract inwardly allowing workpiece 143** to be extracted smoothly.

Incidentally, since inserts 126 are smaller than inserts 125, it is difficult to make inserts 126 movable as are done in the case of inserts 125. However, inserts 126 do not bite into workpiece 143 much, so there is no possibility of their hindering extraction of workpiece 143.

Thus, with this construction, when workpiece 143 is extracted, if there is any pressure on inserts 125 due to workplace 143, inserts 125 retract inwards allowing smooth extraction of workpiece 143. Thus the extraction of workpiece 143 can be achieved easily. Furthermore, base parts **125*b* of inserts 125 fitted into lower die 123 are formed narrower than tip parts 125*a* of inserts 125 projecting from lower die 123, respectively. As a result, the width of the portion of lower die 123 between one recess 124 and an adjacent recess 124 into each of which insert 125 is fitted can be guaranteed to be sufficiently wide while maintaining the necessary receiving face width for workpiece 143. In this way, even when the number of inserts 125 is large as in the drawing, the strength of lower die 123** can be maintained at a high level.

Also, after forming, punches 129 are forcibly retracted since cams 136 pull engaging recesses 140 by means of engaging projections 139 and pull engaging projections 142 by means of engaging recesses 141, respectively. As a result, even if the situation arises of punches 129 biting into workpiece 143 and so becoming difficult to extract, punches 129 can easily be withdrawn from workpiece 143. Furthermore, engaging projection 139 and engaging recess 140 are provided at the top of inclined face 137 of cam 136 and at the top of inclined face 138 of punch 129, respectively, while engaging recess 141 and engaging projection 142 are provided at the bottom of inclined face 137 of cam 136 and at the bottom of inclined face 138 of punch 129, respectively. To sum up, they are formed partially rather than over the entire extent of inclined faces 135, 138. Consequently, sufficient width of the sliding contact area of cam 136 and punch 129 can be guaranteed by the remaining portion, so a high surface pressure is not needed in order to apply pressure to punches 129; a high-capacity press is therefore not required.

It should be noted that once the biting-in of punches 129 can be released from workpiece 143, subsequently punches 129 can be returned by the restoring force provided by respective springs 132. It is therefore sufficient if engaging projections 139 and engaging recesses 140 as well as engaging recesses 141 and engaging projections 142 are formed partially on inclined faces 137, 138, respectively.

Furthermore, there is the advantage that, by providing engaging projections 139 and engaging recesses 140, and engaging recesses 141 and engaging projections 142, at the top and the bottom of inclined faces 137 and 138, respectively, withdrawal of punches 129 can be achieved in a stable manner. This invention is not restricted to this embodiment. They could be provided only at the top or at the bottom of inclined faces 137, 138. They could also be provided only at intermediate parts of inclined faces 137, 138. Furthermore, the engaging projections and engaging recesses need not be T-shaped but could be for example L-shaped. Additionally, workpiece 143 need not necessarily be a motor frame.

In addition to the benefits of the embodiments already described, a press forming device according to the embodiment of this invention described above provides the following benefits. By forming the portion of the insert that fits into the lower die narrower than the portion of the insert that projects from the lower die, extraction of the workpiece can be facilitated without lowering the strength of the lower die. Thanks to the partial formation, on the inclined sliding faces of the punches and cams, of engaging recesses and engaging projections that engage when the cams descend and retract the punches and then separate when the cams are raised, the separation of the workpiece from the punches can be performed in a smooth fashion, without increasing the press capacity.

As will be clear from the above description, according to this invention, in the formation of a plurality of inwardly directed projections on the circumferential wall of a tubular article to be formed, the excellent benefits are obtained that equipment cost can be lowered, the space occupied can be reduced and manufacturing precision raised.

Obviously, numerous modifications and variations of the present invention are possible in light of the above teachings. It is therefore to be understood that within the scope of the appended claims, the invention may be practiced otherwise than as specifically described herein.

What is claimed is:

1. A press forming device for forming a plurality of inwardly directed projections on a circumferential wall of a tubular article to be formed, the press forming device comprising:

a lower die holder adapted to be mounted on a lower base of a press machine;

a die fixed on said lower die holder, said die having a plurality of inside forming parts on a circumferential surface of said die, each for forming one of said projections, respectively;

a plurality of punches mounted on said lower die holder around an outer circumference of said die, each of said punches being arranged to be capable of being moved towards or away from said die, and each of said punches having an outside forming part in a position facing one of said inside forming parts for forming one of said projections, respectively;

an upper die holder adapted to be mounted on an upper raising and lowering base of said press machine; and a plurality of pressing members of wedge shape mounted on said upper die holder, each of said pressing members being mounted at a position above one of said punches for moving one of said punches in a direction towards said die with lowering said raising and lowering base, to thereby press said tubular article between one of said inside forming parts of said die and one of said outside forming parts of said punches, respectively;

whereby said plurality of said projections are formed on said circumferential wall of said tubular article to be formed;

the press forming device further comprising:

a plurality of inserts arranged in the circumference of said die, each of said inserts being movable in a radial direction of said die and being arranged in a position between adjacent two of said inside forming parts of said die, respectively, wherein a radial movement of said inserts facilitate an extraction of said tubular article from said die.

2. The press forming device according to claim 1, further comprising:

an upper die mounted on said upper die holder at a position above said die for contacting with said die with lowering said raising and lowering base and for disconnecting from said die with raising said raising and lowering base.

3. The press forming device according to claim 1, wherein:

each of said punches is provided with a first inclined face of an angle on an outside face of said punch;

each of said pressing members is provided with a second inclined face of said angle on an inside face of said pressing member; and each of said second inclined faces of said pressing members comes into contact with one of said first inclined faces of said punches with lowering said raising and lowering base, and then each of said pressing member moves one of said punches in said direction towards said die with further lowering said raising and lowering base, to thereby press said tubular article between one of said inside forming parts of said die and one of said outside forming parts of said punches, respectively.

4. The press forming device according to claim 3, wherein:

a first engagement portion is partially provided on each of said first inclined faces of said punches;

a second engagement portion is partially provided on each of said second inclined faces of said pressing members; and each of said second engagement portions engages with one of said first engagement portions with lowering said raising and lowering base, respectively, and each of said pressing members retracts one of said punches and then each of said second engagement portions disconnects from one of said first engagement portions with raising said raising and lowering base, respectively.

5. A press forming device for forming a plurality of inwardly directed ribs on a circumferential wall of a tubular article to be formed, the press forming device comprising:

a lower die plate adapted to be mounted on a lower base of the press machine;

a lower die fixed on said lower die plate;

a plurality of inserts arranged in a circumference of said lower die, each of said inserts being movable in a radial direction of said lower die;

a plurality of punches mounted on said lower die plate around an outer circumference of said lower die, each of said punches being arranged to be capable of being moved towards or away from said lower die at an outer position between adjacent two of said inserts, respectively;

an upper die plate adapted to be mounted on an upper raising and lowering base of said press machine;

a plurality of wedges mounted on said upper die plate, each of said wedges being mounted at a position above one of said inserts, respectively; and a plurality of cams mounted on said upper die plate, each of said cams being mounted at a position above one of said punches, respectively;

each of said wedges moving one of said inserts and each of said cams moving one of said punches in a direction towards said lower die with lowering said raising and lowering base, to thereby press said tubular article between said lower die and one of said punches, respectively;

whereby said plurality of said ribs are formed on said circumferential wall of said tubular article to be formed.

6. The press forming device according to claim 5, wherein:

each of said inserts is arranged such that a portion of said insert fitted into said lower die is narrower than a portion of said insert projecting from said lower die.

7. The press forming device according to claim 5, wherein:

each of said punches is provided with a first inclined face of an angle on an outside face of said punch;

each of said cams is provided with a second inclined face of said angle on an inside face of said cam; and each of said second inclined faces of said cams comes into contact with one of said first inclined faces of said punches with lowering said raising and lowering base, and then each of said cams moves one of said punches in said direction towards said lower die with further lowering said raising and lowering base, to thereby press said tubular article between said lower die and one of said punches, respectively.

8. The press forming device according to claim 7, wherein:

a first engagement portion is provided partially on each of said first inclined faces of said punches;

a second engagement portion is partially provided on each of said second inclined faces of said cams; and each of said second engagement portion engages with one of said first engagement portions with lowering said raising and lowering base, respectively, and each of said cams retracts one of said punches and then each of said second engagement portions disconnects from one of said first engagement portions with raising said raising and lowering base, respectively.

* * * * *